US011263989B2

(12) United States Patent
Shin et al.

(10) Patent No.: US 11,263,989 B2
(45) Date of Patent: Mar. 1, 2022

(54) DISPLAY DEVICE AND METHOD OF OPERATING THE SAME

(71) Applicant: Samsung Display Co., Ltd., Yongin-Si (KR)

(72) Inventors: Seung-Woon Shin, Asan-si (KR); Sang Won Kim, Seoul (KR); Jong Woon Kim, Cheonan-si (KR); Kyu-Jin Park, Cheonan-si (KR); Woon-Rok Jang, Cheonan-si (KR); Tae-Seok Ha, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/101,355

(22) Filed: Nov. 23, 2020

(65) Prior Publication Data

US 2021/0272531 A1 Sep. 2, 2021

(30) Foreign Application Priority Data

Feb. 27, 2020 (KR) ..... 10-2020-0024251

(51) Int. Cl.
*G09G 3/36* (2006.01)

(52) U.S. Cl.
CPC ..... *G09G 3/3688* (2013.01); *G09G 3/3677* (2013.01); *G09G 2310/08* (2013.01); *G09G 2320/0252* (2013.01); *G09G 2320/10* (2013.01)

(58) Field of Classification Search
None
See application file for complete search history.

(56) References Cited

U.S. PATENT DOCUMENTS

2006/0221016 A1* 10/2006 Nakamura ..... G09G 3/3283 345/82
2016/0275903 A1* 9/2016 Park ..... G09G 3/20
2018/0103231 A1* 4/2018 Ahn ..... G09G 5/005

FOREIGN PATENT DOCUMENTS

KR 100153053 B1 12/1998
KR 1020180039232 A 4/2018
KR 1020180078996 A 7/2018
KR 101954934 B1 3/2019

* cited by examiner

*Primary Examiner* — Dorothy Harris
(74) *Attorney, Agent, or Firm* — Cantor Colburn LLP

(57) ABSTRACT

A display device includes a display panel, a data driver, a gate driver, and a controller. The display panel includes a plurality of pixels. The data driver provides data voltages to the plurality of pixels through data lines during an active period of a frame period and provides a blank voltage to the plurality of pixels through the data lines during a blank period of the frame period. The gate driver provides a gate-on voltage to the plurality of pixels through gate lines during the active period and provides a gate-off voltage to the plurality of pixels through the gate lines during the blank period. The controller controls the data driver and the gate driver. The blank voltage increases and the gate-off voltage increases, when a time in the blank period reaches a predetermined time.

20 Claims, 13 Drawing Sheets

DISPLAY DEVICE AND METHOD OF OPERATING THE SAME

This patent application claims priority to Korean Patent Application No. 10-2020-0024251, filed on Feb. 27, 2020, and all the benefits accruing therefrom under 35 U.S.C. § 119, the content of which in its entirety is herein incorporated by reference.

TECHNICAL FIELD

The present disclosure relates generally to a display device and a method of operating the same. More particularly, the present disclosure relates to the display device supporting a variable frame mode and the method of operating the same.

DESCRIPTION OF THE RELATED ART

A display device is provided with frame data from a host processor (e.g., a graphic processing unit ("GPU")) and displays an image at a constant frame rate, and is generally driven at about 60 Hertz (Hz). Meanwhile, in order to provide a rich image, the host processor may perform rendering and high-definition game images, virtual reality images, and the like require a lot of time to render in the host processor. Accordingly, it may take a long time for the host processor to provide an image signal to the display device. In other words, as the frame rate of the host processor is changed, the frame rate of the host processor and the frame rate of the display device may not match each other. Due to such the mismatch of the frame rate of the host processor and the frame rate of the display device, a boundary line may be visually recognized in an image displayed on the display device, or an image displayed on the display device may be delayed.

To prevent such boundary line visibility and image delay, by synchronizing a start of the frame with a time when the host processor performs rendering, the frame rate of the host processor and the frame rate of the display device can be synchronized. This technique is called a variable frame mode (e.g., a free-sync mode, a G-sync mode, etc.).

SUMMARY

However, the blank period of the display device supporting the variable frame mode may increase compared to a blank period in a normal mode displaying an image at a constant frame rate. Accordingly, a luminance may be further degraded due to a leakage current leaked during the increased blank period, and an image quality may be deteriorated.

An embodiment of the inventive concept provides a display device capable of improving an image quality in a variable frame mode.

Another embodiment of the inventive concept provides a method of operating the display device.

According to an embodiment of the inventive concept, a display device includes a display panel, a data driver, a gate driver, and a controller. The display panel includes a plurality of pixels. The data driver provides data voltages to the plurality of pixels through data lines during an active period of a frame period and provides a blank voltage to the plurality of pixels through the data lines during a blank period of the frame period. The gate driver provides a gate-on voltage to the plurality of pixels through gate lines during the active period and provides a gate-off voltage to the plurality of pixels through the gate lines during the blank period. The controller controls the data driver and the gate driver. The blank voltage increases and the gate-off voltage increases, when a time in the blank period reaches a predetermined time.

In an embodiment, the active period may have a constant time length, and the blank period may have a variable time length.

In an embodiment, the predetermined time may be a length of the blank period corresponding to the maximum frame rate in a variable frame rate range supported by the display device.

In an embodiment, the gate-off voltage before the predetermined time is reached may have a first negative value and the gate-off voltage after the predetermined time may have a second negative value. An absolute value of the second negative value may be smaller than an absolute value of the first negative value.

In an embodiment, the gate-off voltage after the predetermined time may be constant.

In an embodiment, the gate-off voltage after the predetermined time may increase gradually as the time in the blank period increases.

In an embodiment, the blank voltage after the predetermined time may be set to an average value of the data voltages provided to the plurality of pixels during the active period.

In an embodiment, the blank voltage after the predetermined time may be set to the maximum value of the data voltages provided to the plurality of pixels during the active period.

In an embodiment, the blank voltage after the predetermined time may be set to the same value as the data voltage corresponding to the maximum gray level.

In an embodiment, the blank voltage after the predetermined time may be set for each of the data lines.

In an embodiment, a leakage current of the plurality of pixels may reduce based on the blank voltage during the blank period after the predetermined time.

According to an embodiment of the inventive concept, a method of operating a display device includes providing data voltages to a plurality of pixels during an active period of a frame period, providing a gate-on voltage to the plurality of pixels during the active period, providing a blank voltage to the plurality of pixels during an blank period of the frame period, providing a gate-off voltage to the plurality of pixels during the blank period, increasing the blank voltage when a time in the blank period reaches a predetermined time, and increasing the gate-off voltage when the time in the blank period reaches a predetermined time.

In an embodiment, the active period may have a constant time length and the blank period may have a variable time length.

In an embodiment, the predetermined time may be a length of the blank period corresponding to the maximum frame rate in a variable frame rate range supported by the display device.

In an embodiment, the gate-off voltage after the predetermined time may be constant.

In an embodiment, the gate-off voltage after the predetermined time may increase gradually as the time in the blank period increases.

In an embodiment, the blank voltage after the predetermined time may be set to an average value of the data voltages provided to the plurality of pixels during the active period.

In an embodiment, the blank voltage after the predetermined time may be set to the maximum value of the data voltages provided to the plurality of pixels during the active period.

In an embodiment, the blank voltage after the predetermined time may be set to the same value as the data voltage corresponding to the maximum gray level.

In an embodiment, the blank voltage after the predetermined time may be set for each of the data lines.

Therefore, in a display device according to an embodiment, during a blank period after a predetermined time, a blank voltage provided to the pixel may increase, and a gate-off voltage provided to the pixel may increase. Accordingly, the display device may reduce a leakage current leaked from the pixel during the blank period after the predetermined time. Accordingly, even if time lengths of the blank periods are different for each frame period, a deviation in the amount of leakage current leaked for each frame period may be reduced.

BRIEF DESCRIPTION OF THE DRAWINGS

The above and other features of the inventive concept will become more apparent by describing in detail embodiments thereof with reference to the accompanying drawings, in which.

DETAILED DESCRIPTION

Hereinafter, exemplary embodiments of the present inventive concept will be explained in detail with reference to the accompanying drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
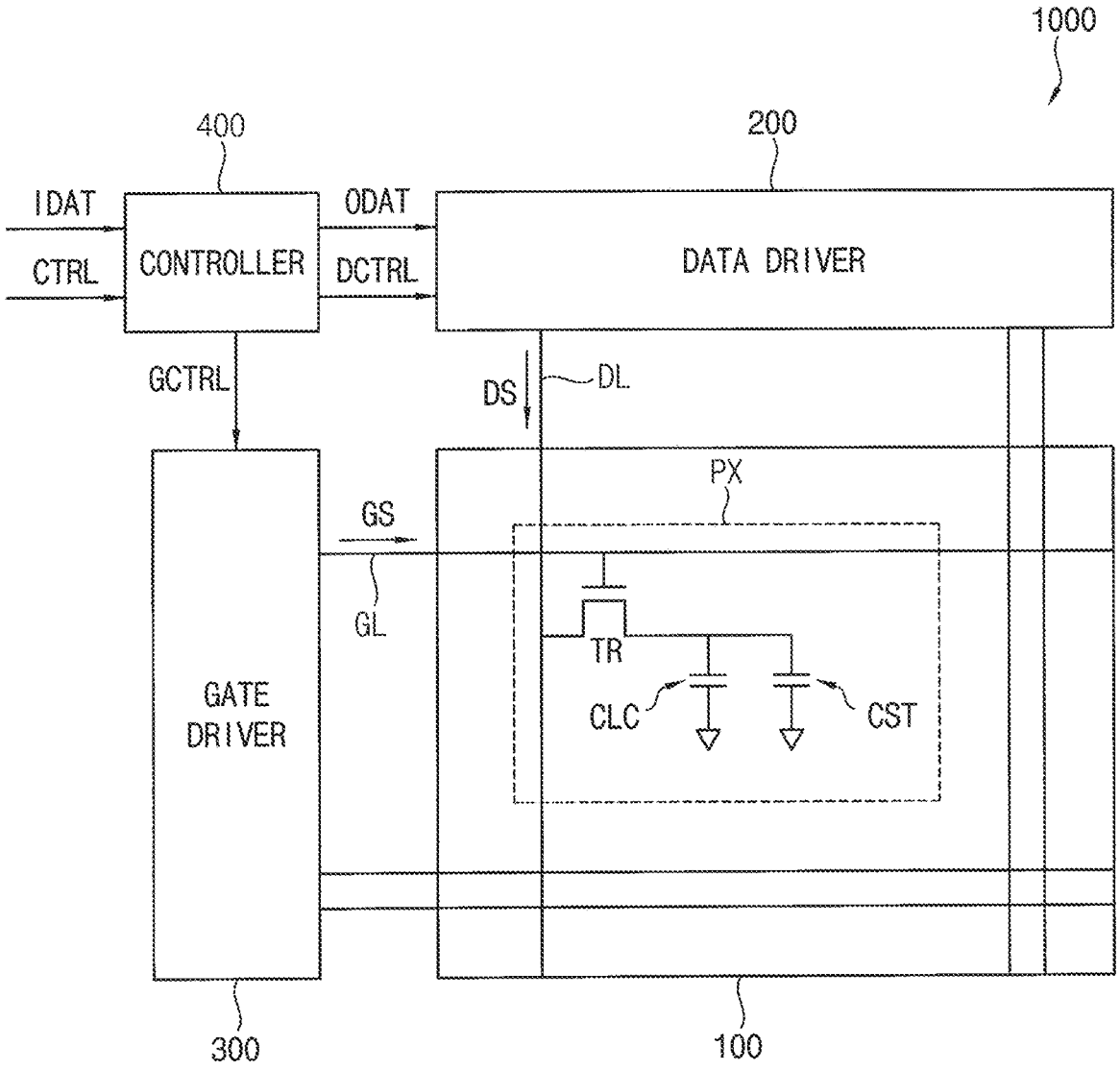
FIG. 1 is a block diagram illustrating a display device according to an embodiment of the inventive concept.

FIG. 1 is a block diagram illustrating a display device according to an embodiment of the inventive concept.

Referring to FIG. 1, a display device 1000 according to an embodiment of the inventive concept may include a display panel 100, a data driver 200, a gate driver 300, and a controller 400. The display panel 100 may include data lines DL, gate lines GL, and a plurality of pixels PX. The data driver 200 may provide data signals DS (e.g., a data voltage or a blank voltage) to the plurality of pixels PX through the data lines DL. The gate driver 300 may provide gate signals GS (e.g., a gate-on voltage or a gate-off voltage) to the plurality of pixels PX through the gate lines GL. The controller 400 may control the data driver 200 and the gate driver 300.

The display panel 100 may include the data lines DL, the gate lines GL, and the plurality of pixels PX connected to the data lines DL and the gate lines GL. For example, the display panel 100 may be a liquid crystal display ("LCD"), but the invention is not limited thereto, and may be any display panel.

Each of the plurality of pixels PX may include a switching transistor TR, a liquid crystal capacitor CLC connected to the switching transistor TR, and a storage capacitor CST connected to the switching transistor TR.

The switching transistor TR may be electrically connected to a gate line GL and a data line DL. The switching transistor TR may output the data signals DS in response to the gate signal GS. The liquid crystal capacitor CLC and the storage capacitor CST may be charged based on the data signals DS (e.g., the data voltages) output from the switching transistor TR. The liquid crystal capacitor CLC may change an arrangement of liquid crystal directors of the liquid crystal display, and the storage capacitor CST may maintain the arrangement of the liquid crystal directors of liquid crystal display for a preset time.

As an off characteristic of the switching transistor TR is weakened during a blank period, the data voltage charged in the liquid crystal capacitor CLC and the storage capacitor CST may leak through the switching transistor TR. In particular, as the blank voltage having a lower voltage level is provided to the switching transistor TR through the data line DL, a greater amount of current may leak through the switching transistor TR.

The data driver 200 may generate the data signals DS based on an image data ODAT and a data control signal DCTRL provided from the controller 400, and may provide the data signals DS to the plurality of pixels PX. In an embodiment, the data driver 200 may provide the data voltages as data signals DS corresponding to the image data ODAT to the plurality of pixels PX through the data lines DL during an active period of a frame period and may provide the blank voltage as data signals DS to the plurality of pixels PX through the data lines DL during a blank period of the frame period. For example, the data control signal DCTRL may include an output data enable signal, a horizontal start signal, and a load signal. In an embodiment, the data driver 200 may be implemented with one or more integrated circuits ("IC"s). In another embodiment, the data driver 200 may be directly mounted on the display panel 100, may be connected to the display panel 100 in a form of a chip on film ("COF"), or may be integrated on a periphery of the display panel 100.

The gate driver 300 may generate the gate signals GS based on a gate control signal GCTRL provided from the controller 400 and may transmit the gate signals GS to the plurality of pixels PX through the gate lines GL. For example, the gate control signal GCTRL may include a vertical start signal, a clock signal, and the like. In addition, the gate driver 300 may be further provided with the gate-on voltage and the gate-off voltage from the controller 400 or from a power management circuit (not shown) and may provide the gate-on voltage and the gate-off voltage as the gate signals GS to each pixel. In an embodiment, the gate driver 300 may sequentially provide the gate-on voltage as the gate signals GS to the plurality of pixels PX through the gate lines GL during the active period by pixel row unit (i.e., pixels PX connected to the same gate line GL) and may provide the gate-off voltage as the gate signals GS to the plurality of pixels PX through the gate lines GL during the blank period. In an embodiment, the gate driver 300 may be directly mounted on the display panel 100. In another embodiment, the gate driver 300 may be connected to the display panel 100 in the form of the COF.

The controller 400 (e.g., a timing controller T-CON) may receive an input image data IDAT and a control signal CTRL from an external host processor (e.g., GPU). For example, the input image data IDAT may be a RGB data including a red (R) image data, a green (G) image data, and a blue (B) image data. In addition, the control signal CTRL may include a vertical synchronization signal, a horizontal synchronization signal, an input data enable signal, a master clock signal, and the like. The controller 400 may provide the gate control signal GCTRL to the gate driver 300 and may provide the data control signal DCTRL and the image data ODAT to the data driver 200, based on the input image data IDAT and the control signal CTRL.

In the display device 1000 according to an embodiment of the inventive concept, the controller 400 may control the data driver 200 to increase the blank voltage when a time of the blank period reaches a predetermined time and may control the gate driver 300 to increase the gate-off voltage when the time of the blank period reaches the predetermined time. Accordingly, in the plurality of pixels PX of the display device 1000, a leakage current leaked during the blank period after the predetermined time may be reduced. Therefore, the display device 1000 can reduce a deviation of a leakage current leaked in each frame period, even if time lengths of the blank periods are different for each frame period.

Figure 2:
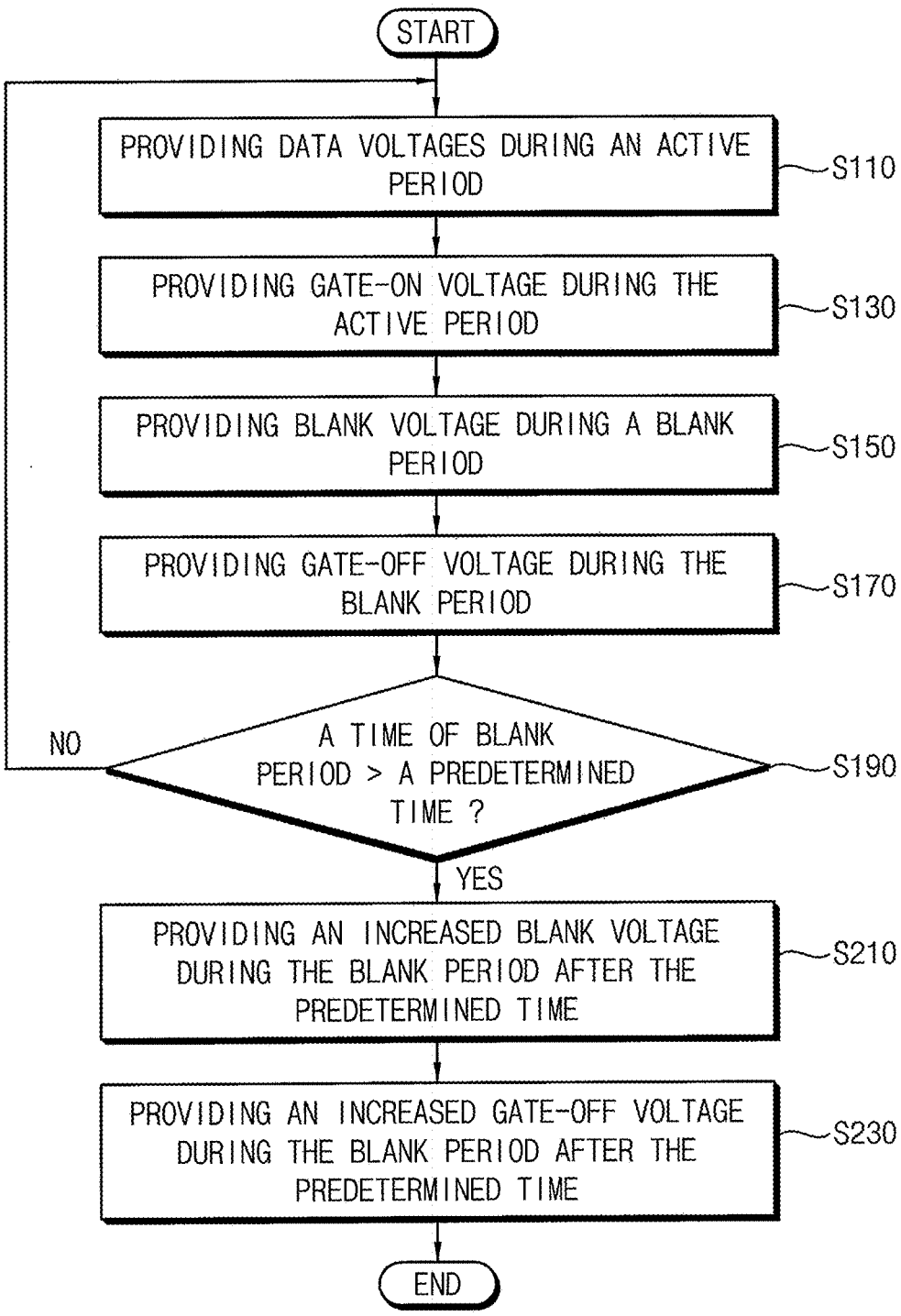
FIG. 2 is a flowchart illustrating a method of operating a display device according to an embodiment of the inventive concept.
Figure 3:
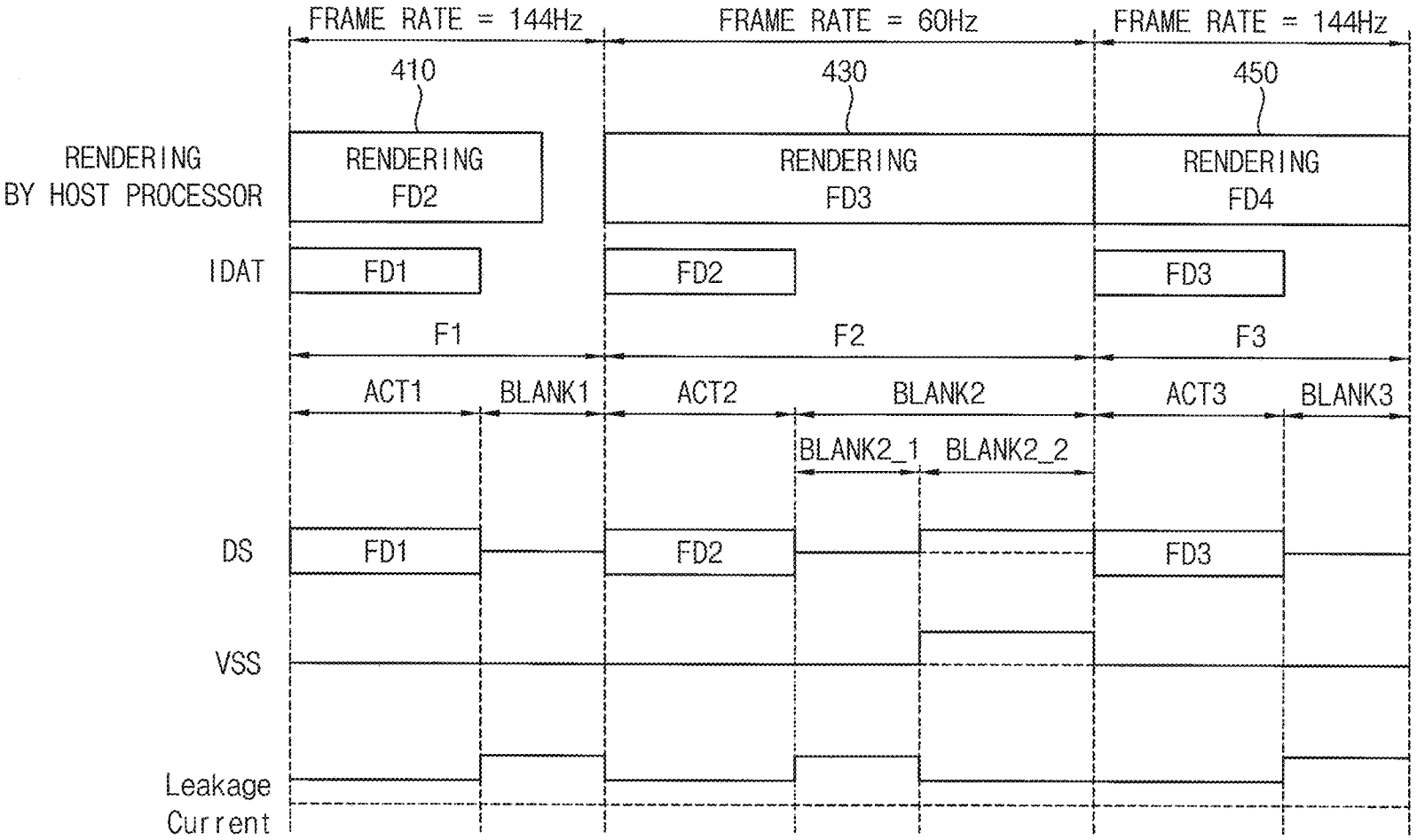
FIG. 3 is a timing diagram illustrating an example in which a blank voltage and a gate-off voltage are changed according to the method of operating the display device of FIG. 2.

FIG. 2 is a flowchart illustrating a method of operating a display device according to an embodiment of the inventive concept. FIG. 3 is a timing diagram illustrating an example in which a blank voltage and a gate-off voltage are changed according to the method of operating the display device of FIG. 2. FIGS. 4 to 9 are diagrams for explaining examples of an increased blank voltage during a blank period after a predetermined time. FIG. 10 is a circuit diagram illustrating a pixel included in the display device of FIG. 1.

Referring to FIGS. 1, 2, and 3, the data driver 200 may provide the data voltages as the data signals DS to the plurality of pixels PX during the active period of the frame period (S110). The gate driver 300 may provide the gate-on voltage as the gate signals GS to the plurality of pixels PX during the active period (S130). In other words, the gate-on voltage may be sequentially provided to the plurality of pixels PX by pixel row unit during the active period, and the liquid crystal capacitor CLC and the storage capacitor CST of each of the plurality of pixels PX may receive the data voltage through the switching transistor TR turned on in response to the gate-on voltage. Accordingly, the data voltage may be charged in the liquid crystal capacitor CLC and the storage capacitor CST.

The data driver 200 may provide the blank voltage as the data signals DS to the plurality of pixels PX during the blank period following the active period (S150). The gate driver 300 may provide the gate-off voltage as the gate signals GS to the plurality of pixels PX during the blank period (S170). In other words, the blank voltage may be provided to a source of the switching transistor TR of each of the plurality of pixels PX, and the gate-off voltage may be provided to a gate of the switching transistor TR of each of the plurality of pixels PX. In an embodiment, the blank voltage may be the same as the data voltage corresponding to the lowest gray level, but the invention is not limited thereto.

The controller 400 may compare the time of the blank period with the predetermined time (S190). In an embodiment, the active period may be a fixed active period having a constant time length and the blank period may be a variable blank period having a variable time length. In addition, the predetermined time may be the time of the blank period corresponding to the maximum frame rate in a variable frame rate range supported by the display device. A detailed description of this will be described later with reference to FIG. 3.

When the time of the blank period reaches the predetermined time, if the blank period ends and a next frame period starts (S190: NO), the controller 400 may control the data driver 200 such that the data driver 200 provides the data voltages to the plurality of pixels PX during the active period of the next frame period (S110) and may control the gate driver 300 such that the gate driver 300 provides the gate-on voltage to the plurality of pixels PX during the active period of the next frame period (S130).

On the other hand, when the time of the blank period reaches the predetermined time, if the blank period continues without being finished (S190: YES), the controller 400 may control the data driver 200 such that the data driver 200 provides an increased blank voltage to the plurality of pixels PX during the blank period after the predetermined time (S210) and may control the gate driver 300 such that the gate driver 300 provides an increased gate-off voltage to the plurality of pixels PX during the blank period after the predetermined time (S230).

For example, as shown in FIG. 3, a period or a frequency of a rendering 410, 430, and 450 performed by the host processor may not be constant, and the host processor may provide the input image data IDAT, that is, a frame data FD1, FD2, and FD3, to the display device 1000 in synchronization with the non-constant period or frequency of the rendering 410, 430, and 450. Accordingly, frame periods F1, F2, and F3 of the display device 1000 may include the fixed active period ACT1, ACT2, and ACT3 having the constant time length and the variable blank period BLANK1, BLANK2, and BLANK3 having the variable time length, respectively. As a frame rate increases, the time length of one frame period may decrease, and as the frame rate decreases, the time length of one frame period may increase. The frame rate may mean a number of frames transmitted per second (Hz or frame/s).

In detail, when the second frame data FD2 is rendered 410 at a frequency greater than about 144 Hz in the first frame period F1, the host processor may provide the first frame data FD1 at a frame rate of about 144 Hz to the display device 1000. In addition, the host processor may output the second frame data FD2 during the active period ACT2 of the second frame period F2, and may continue the blank period BLANK2 of the second frame period F2 until the rendering 430 for the third frame data FD3 is completed. Accordingly, when the third frame data FD3 is rendered 430 at a frequency of about 60 Hz in the second frame period F2, the host processor may provide the second frame data FD2 to the display device 1000 at a frame rate of about 60 Hz by increasing the blank period BLANK2 of the second frame period F2. When the fourth frame data FD4 is again rendered 450 at a frequency of about 144 Hz in the third frame period F3, the host processor may provide the third frame data FD3 to the display device 1000 again at a frame rate of about 144 Hz.

One frame period of the display device 1000 may include the active period in which frame data is output and the blank period following the active period. For example, the first frame period F1 of the display device 1000 may include the active period ACT1 in which the first frame data FD1 is output and the blank period BLANK1 following the active period ACT1. The second frame period F2 of the display device 1000 may include the active period ACT2 in which the second frame data FD2 is output and the blank period BLANK2 following the active period ACT2. During each active period ACT1, ACT2, and ACT3, the data voltages may be charged in the plurality of pixels PX, and accordingly, the display device 1000 may display an image. During each blank period BLANK1, BLANK2, and BLANK3, the data voltages may be stored in the plurality of pixels PX, and accordingly, the display device 1000 may maintain the displayed image.

In an embodiment, the active period (e.g., ACT1) may be the fixed active period having the constant time length. In other words, the time lengths of the active periods ACT1, ACT2, and ACT3 may be the same. On the other hand, the blank period may be the variable blank period having the variable time length. In other words, the time lengths of the blank periods BLANK1, BLANK2, and BLANK3 may differ from each other according to the time lengths of the frame periods F1, F2, and F3. For example, the time length of the blank period BLANK2 of the second frame period F2 may be longer than the time length of the blank period BLANK1 of the first frame period F1.

The frame periods F1, F2, and F3 may include the active periods ACT1, ACT2, and ACT3 having the constant time length and the blank periods BLANK1, BLANK2, and BLANK3 having the variable time length, respectively. A technique of synchronizing the time length of the frame period and the time length at which the host processor performs rendering by varying the time length of the blank period may be called a variable frame mode. In the display device 1000 supporting the variable frame mode, unlike a display device supporting a normal mode, a boundary line due to a frame rate mismatch may not be visually recognized, and an image displayed on the display device 1000 may not be delayed.

The data voltage charged in the liquid crystal capacitor CLC and the storage capacitor CST during the active period must be maintained during the blank period. However, during the blank period in which the blank voltage is applied to the switching transistor TR, the data voltage charged in the liquid crystal capacitor CLC and the storage capacitor CST may leak through the switching transistor TR. In particular, as the time lengths of the blank periods are different from each other as described above, the amount of leakage current leaked through the switching transistor TR for each frame period F1, F2, and F3 may vary.

However, in an embodiment, when the time of the blank period reaches the predetermined time, the controller 400 may control the data driver 200 to increase the blank voltage and may control the gate driver to increase the gate-off voltage VSS. In other words, when the time of the blank period reaches the predetermined time, the blank voltage may be increased, and the gate-off voltage VSS may be increased. Accordingly, the amount of leakage current leaked during the blank period after the predetermined time may be reduced. Accordingly, the deviation between the amount of the leakage current leaked during the blank period having a time length equal to the predetermined time and the amount of leakage current leaked during the blank period having a time length greater than the predetermined time may be reduced in the embodiment. In other words, the deviation between the amount of the leakage current leaked during the blank period BLANK1 of the first frame period F1 and the amount of leakage current leaked during the blank period BLANK2 of the second frame period F2 may be reduced.

In an embodiment, the predetermined time is a time of the blank period corresponding to the maximum frame rate in the variable frame rate range supported by the display device 1000. For example, the variable frame rate range supported by the display device 1000 may be about 48 Hz to about 144 Hz. In this case, the maximum frame rate may be 144 Hz, and the time of the blank period corresponding to the maximum frame rate may be the same as the time of the blank period BLANK1 of the first frame period F1. In addition, the time of the blank period corresponding to the maximum frame rate may be the same as the time of the blank period BLANK3 of the third frame period F3.

As described above, the time of the blank period BLANK2 of the second frame period F2 may be longer than the time of the blank period BLANK1 of the first frame period F1. Accordingly, the blank period BLANK2 of the second frame period F2 may be divided into a blank period BLANK2_1 which corresponds to the predetermined time and a blank period BLANK2_2 which is a period after the predetermined time. Therefore, in the second frame period F2, the time of the blank period BLANK2_1 may be the same as the time of the blank period BLANK1 of the first frame period F1.

As described above, when the time of the blank period BLANK2 of the second frame period F2 reaches the predetermined time, the controller 400 may control the gate driver 300 to increase the gate-off voltage VSS (S210). In other words, the plurality of pixels PX may receive the increased gate-off voltage VSS during the blank period BLANK2_2.

In an embodiment, the gate-off voltage VSS before the predetermined time is reached may have a first negative value, and the increased gate-off voltage VSS after the predetermined time may have a second negative value whose absolute value is smaller than an absolute value of the first negative value. In an embodiment, for example, in the second frame period F2, the increased gate-off voltage VSS provided to the plurality of pixels PX during the blank period BLANK2_2 after the predetermined time may be approximately −7 voltages (V) and the increased gate-off voltage VSS provided to the plurality of pixels PX during the blank period BLANK2_1 before the predetermined time is reached may be approximately −9V.

In addition, the increased gate-off voltage VSS may be constant during the blank period after the predetermined time. For example, in the second frame period F2, the gate-off voltage VSS provided to the plurality of pixels PX during the blank period BLANK2_2 after the predetermined time may be constant at about −7V.

As described above, the controller 400 may control the data driver 200 to increase the blank voltage when the blank period BLANK2 of the second frame period F2 reaches the predetermined time (S230). In other words, the plurality of pixels PX may receive the increased blank voltage during the blank period BLANK2_2 after the predetermined time.

Figure 4:
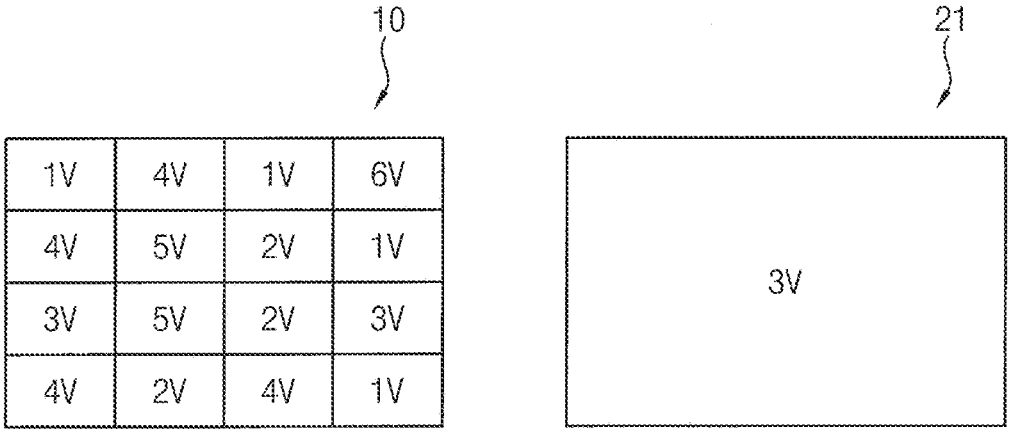
FIGS. 4 to 9 are diagrams for explaining examples of an increased blank voltage during a blank period after a predetermined time.
Figure 5:
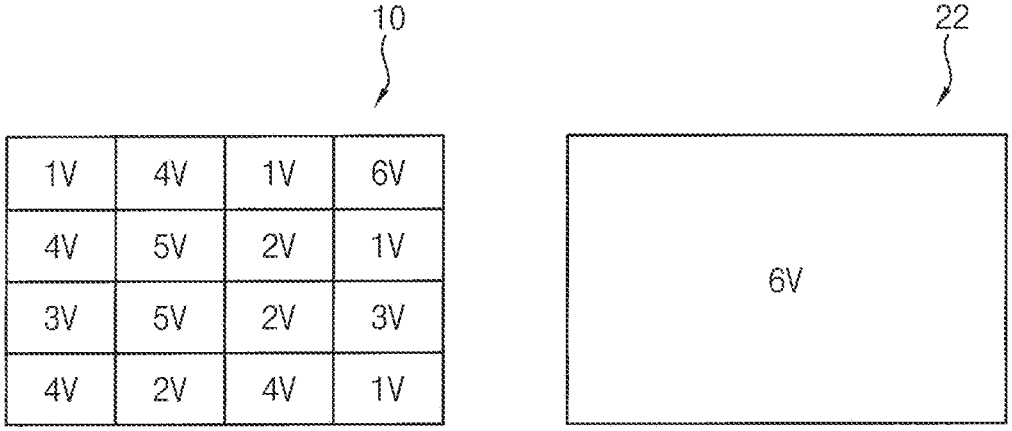

Referring to FIGS. 4 and 5, the display panel 100 may include the plurality of pixels PX. In detail, the display panel 100 may include the gate lines GL, the data lines DL, and the pixels PX formed at an area where the gate lines GL and the data lines DL cross each other. For example, as shown in FIGS. 4 and 5, the display panel 100 may include 16 pixels PX.

In an embodiment, as shown in FIG. 4, the increased blank voltage may be set to an average value of the data voltages provided to the plurality of pixels PX disposed on the display panel 100 during the active period. In detail, a data voltage table 10 may represent the data voltages provided to the 16 pixels PX during the active period ACT2 of the second frame period F2. A first blank voltage table 21 may represent the increased blank voltage provided to the display panel 100 during the blank period BLANK2_2 after the predetermined time during the blank period BLANK2 of the second frame period F2. The increased blank voltage may be set to the average value of the data voltages provided to the 16 pixels PX during the active period ACT2.

In another embodiment, as shown in FIG. 5, the increased blank voltage may be set to the maximum value of the data voltages provided to the plurality of pixels PX disposed on the display panel 100 during the active period. In detail, the data voltage table 10 may represent the data voltages provided to the 16 pixels PX during the active period ACT2 of the second frame period F2. A second blank voltage table 22 may represent the increased blank voltage provided to the display panel 100 during the blank period BLANK2_2 after the predetermined time during the blank period BLANK2 of the second frame period F2. For example, since the maximum value of the data voltages provided to the 16 pixels PX during the active period ACT2 is about 6V, the increased blank voltage may be set to about 6V.

In still another embodiment, the increased blank voltage may be set to the same value as the data voltage corresponding to the maximum gray level. For example, each of the plurality of pixels PX may display gray levels within 0 to 255 gray levels, and the increased blank voltage may be set to the same value as the data voltage corresponding to 255 gray level.

Figure 6:
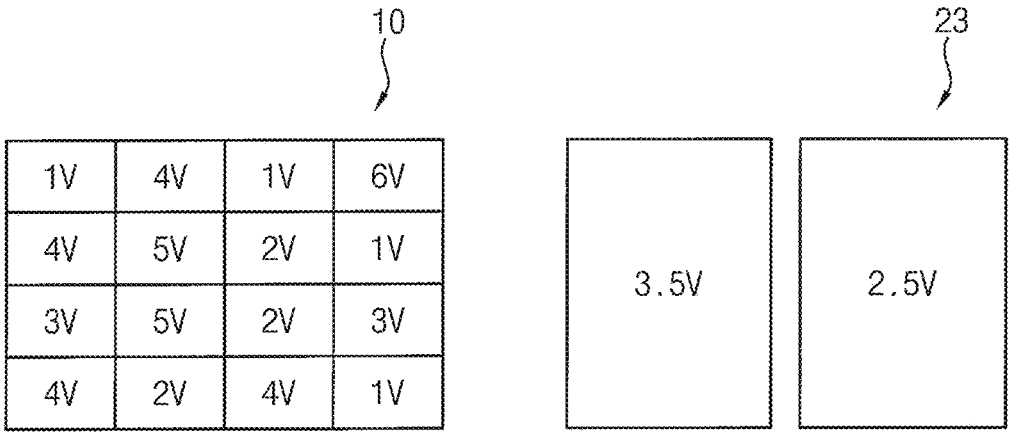
Figure 7:
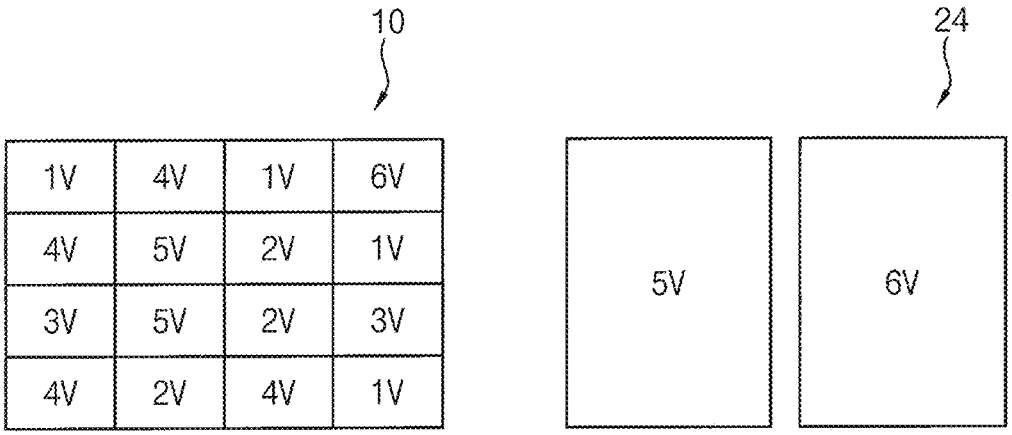

Referring to FIGS. 6 and 7, the display panel 100 may be divided into a plurality of regions, and each of the regions may include a plurality of pixels PX. For example, as shown in FIGS. 6 and 7, the display panel 100 may be divided into two regions, and each region may include eight pixels PX.

In an embodiment, as shown in FIG. 6, the increased blank voltage may be set to an average value of the data voltages provided to the plurality of pixels PX disposed in each of the regions during the active period. In detail, the data voltage table 10 may represent the data voltages provided to the 16 pixels PX during the active period ACT2 of the second frame period F2. A third blank voltage table 23 may represent the increased blank voltages provided to the two regions during the blank period BLANK2_2 after the predetermined time during the blank period BLANK2 of the second frame period F2. Each of the increased blank voltages may be set to the average value of the data voltages provided to the eight pixels PX disposed in each of the regions during the active period ACT2. In other words, for example, the increased blank voltage provided to the eight pixels PX disposed in a first region (i.e., left half region) may be about 3.5V, which is the average value of the data voltages provided to the eight pixels PX disposed in the first region. In addition, the increased blank voltage provided to the eight pixels PX disposed in a second region (i.e., right half region) may be about 2.5V, which is the average value of the data voltages provided to the eight pixels PX disposed in the second region.

In another embodiment, as shown in FIG. 7, the increased blank voltage may be set to the maximum value of the data voltages provided to the plurality of pixels PX disposed in each of the regions during the active period. In detail, the data voltage table 10 may represent the data voltages provided to the 16 pixels PX during the active period ACT2 of the second frame period F2. A fourth blank voltage table 24 may represent the increased blank voltages provided to the two regions during the blank period BLANK2_2 after the predetermined time during the blank period BLANK2 of the second frame period F2. The increased blank voltage may be set to the maximum value of the data voltages provided to the eight pixels PX disposed in each of the regions during the active period ACT2. In other words, for example, the increased blank voltage provided to the eight pixels PX disposed in the first region (i.e., left half region) may be about 5V, which is the maximum value of the data voltages provided to the eight pixels PX disposed in the first region. In addition, the increased blank voltage provided to the eight pixels PX disposed in the second region (i.e., right half region) may be about 6V, which is the maximum value of data voltages provided to the eight pixels PX disposed in the second region.

In FIGS. 6 and 7, the method of operating the display device 1000 for driving the display panel 100 by dividing the display panel 100 into two regions is described, but the inventive concept is not limited thereto. In another embodiment, for example, the display panel 100 may be divided into four regions, and the plurality of pixels arranged in a matrix form may be disposed in each of the four regions.

Figure 8:
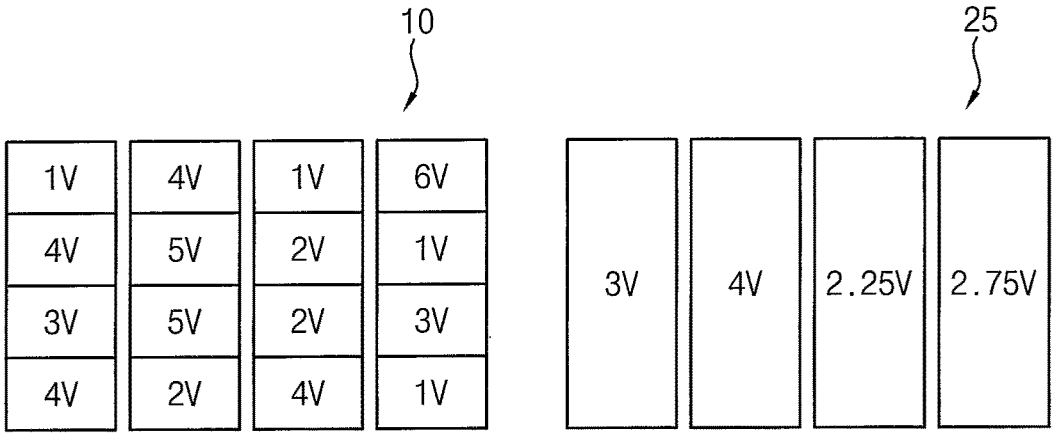
Figure 9:
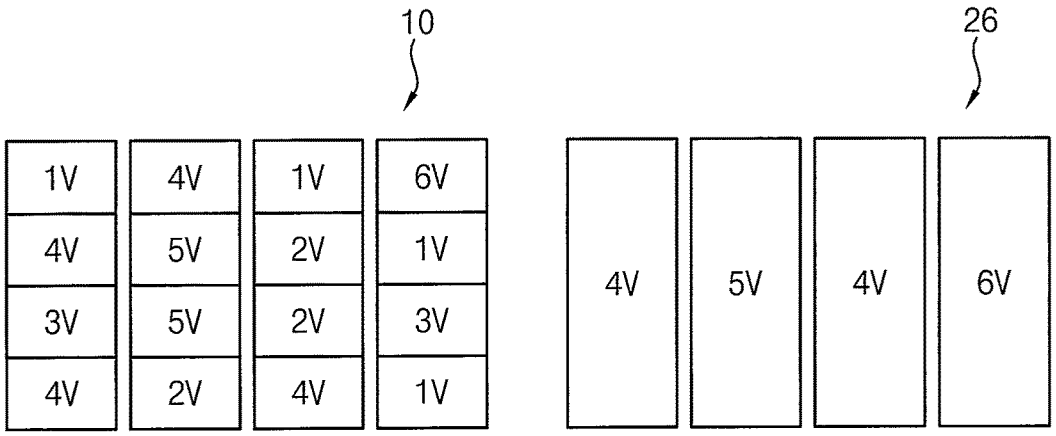
Figure 10:
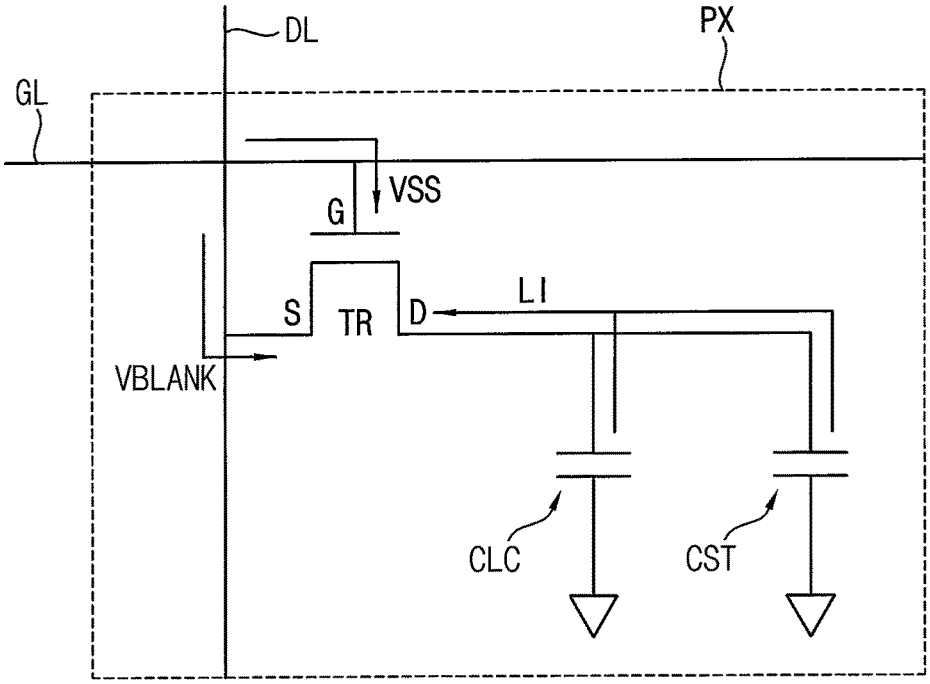
FIG. 10 is a circuit diagram illustrating a pixel included in the display device of FIG. 1.

Referring to FIGS. 8 and 9, the increased blank voltage may be set for each of the data lines DL.

In an embodiment, as shown in FIG. 8, the increased blank voltage provided to each of the data lines DL may be set to an average value of the data voltages provided to each of the data lines DL. In detail, the data voltage table 10 may represent the data voltages provided to the 16 pixels PX during the active period ACT2 of the second frame period F2. A fifth blank voltage table 25 may represent the increased blank voltages provided to the four regions during the blank period BLANK2_2 after the predetermined time during the blank period BLANK2 of the second frame period F2. For example, the data voltages provided to a first data line (i.e., the leftmost data line) may be about 1V, 4V, 3V, and 4V, and the increased blank voltage provided to the first data line may be set to about 3V, which is the average value of the data voltages of the first data line. In addition, the data voltages provided to a second data line (i.e., data line next to the first data line) may be about 4V, 5V, 5V, and 2V, and the increased blank voltage provided to the second data line may be set to about 4V, which is the average value of the data voltages of the second data line.

In another embodiment, as shown in FIG. 9, the increased blank voltage provided to each of the data lines DL may be set to the maximum value of the data voltages provided to each of the data lines DL. In detail, the data voltage table 10 may represent the data voltages provided to the 16 pixels PX during the active period ACT2 of the second frame period F2. A sixth blank voltage table 26 may represent the increased blank voltages provided to the four regions during the blank period BLANK2_2 after the predetermined time during the blank period BLANK2 of the second frame period F2. For example, the data voltages provided to a first data line (i.e., the leftmost data line) may be about 1V, 4V, 3V, and 4V, and the increased blank voltage provided to the first data line may be set to about 4V, which is the maximum value of the data voltages of the first data line. In addition, the data voltages provided to a second data line (i.e., data line next to the first data line) may be about 4V, 5V, 5V, and 2V, and the increased blank voltage provided to the second data line may be set to about 5V, which is the maximum value of the data voltages of the second data line.

A method of setting the increased blank voltage according to the inventive concept is not limited to the method described with reference to FIGS. 4 to 9. In another embodiment, for example, the increased blank voltage may have a preset value, or may gradually increase (or decrease) according to the time length of the blank period in another embodiment.

Referring to FIG. 10, in the display device 1000, as the blank voltage VBLANK provided to a source S of the switching transistor TR increases during the blank period after the predetermined time (e.g., BLANK2_2 in FIG. 3), a difference between a voltage at a drain D of the switching transistor TR (e.g., the data voltage stored in the liquid crystal capacitor CLC and the storage capacitor CST) and the blank voltage VBLANK may be reduced. Accordingly, a source-drain voltage difference of the switching transistor TR may be reduced, and a leakage current LI leaking from the liquid crystal capacitor CLC and the storage capacitor CST to the data line DL may be reduced.

In addition, in the display device 1000, as the blank voltage VBLANK provided to the source S of the switching transistor TR and the gate-off voltage VSS provided to a gate G of the switching transistor TR increase during the blank period after the predetermined time (e.g., BLANK2_2 in FIG. 3), the blank voltage VBLANK may be set to be larger than a voltage at the drain D of the switching transistor TR. For example, the voltage at the drain D may be the data voltage stored in the liquid crystal capacitor CLC and the storage capacitor CST. Accordingly, a source voltage (i.e., voltage at the source S) of the switching transistor TR may be greater than a drain voltage (i.e., voltage at the drain D) of the switching transistor TR, and a luminance may not decrease during the blank period after the predetermined time.

The display device 1000 may increase the blank voltage VBLANK provided to the source of the switching transistor TR and the gate-off voltage VSS provided to the gate of the switching transistor TR during the blank period after the predetermined time. Accordingly, even if the time lengths of the blank periods are different for each frame period, the deviation between the amount of leakage current leaked for each frame period may be reduced. Therefore, the display device 1000 may prevent the luminance from decreasing during the blank period after the predetermined time.

Figure 11:
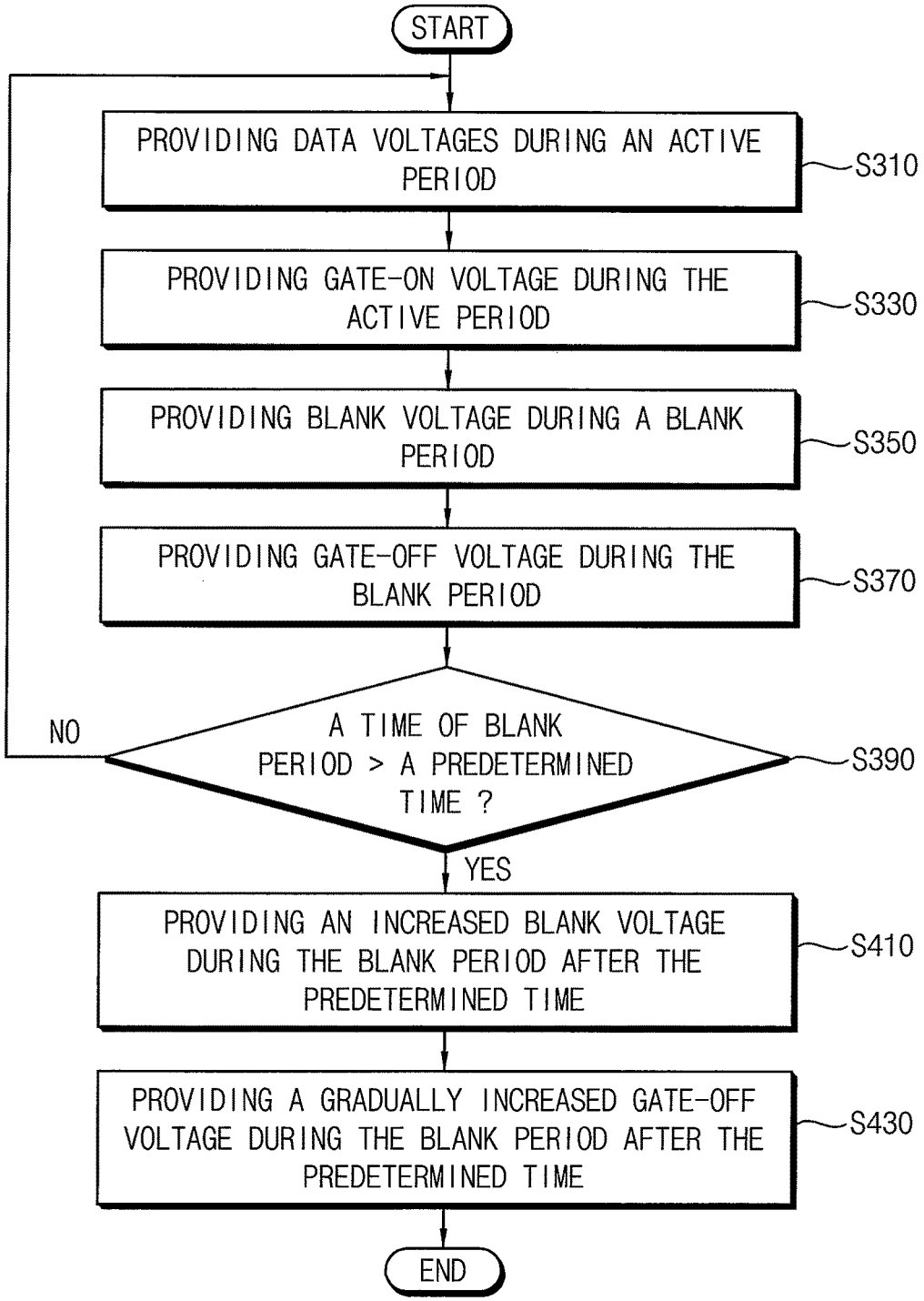
FIG. 11 is a flowchart illustrating a method of operating a display device according to another embodiment of the inventive concept.
Figure 12:
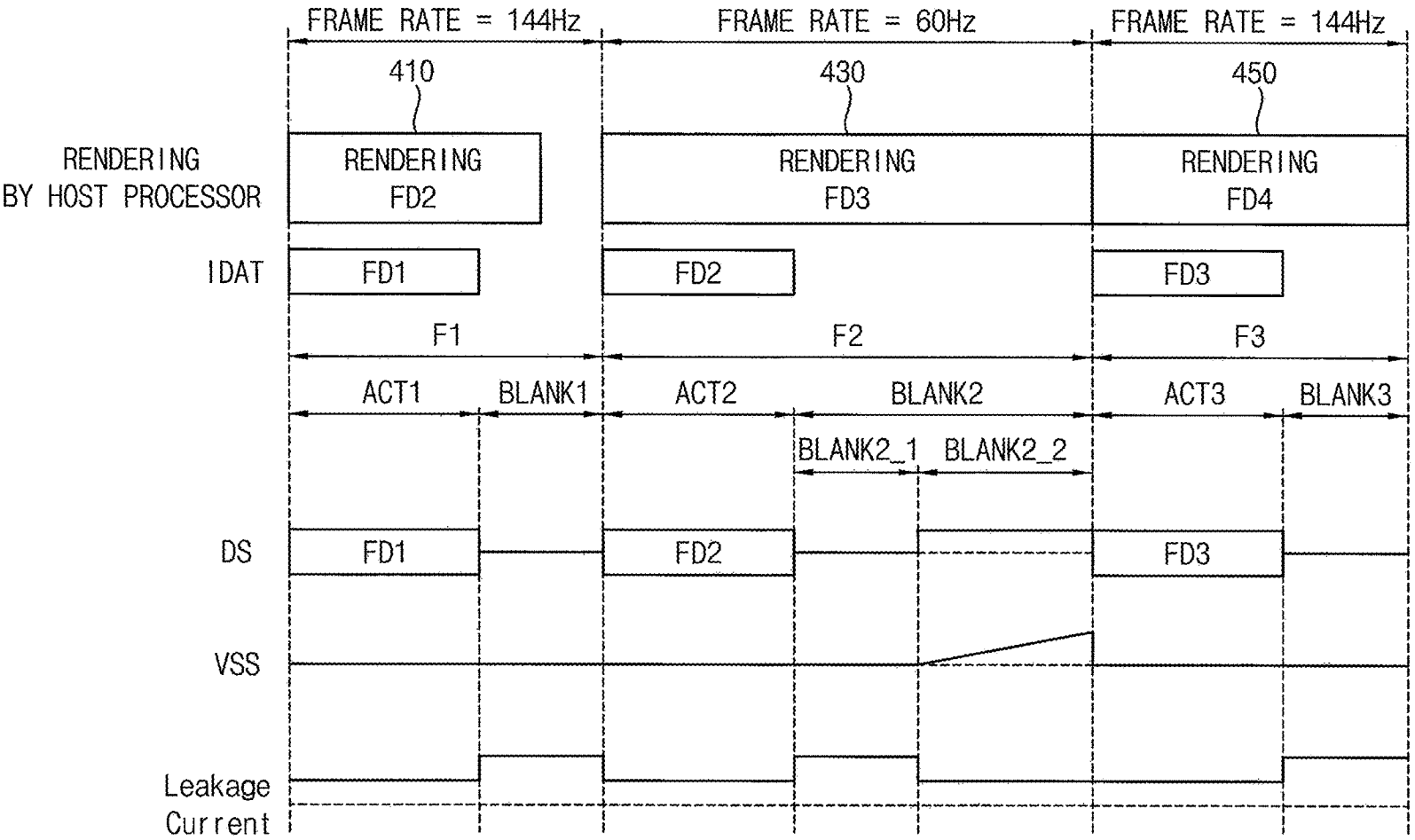
FIG. 12 is a timing diagram illustrating an example in which a blank voltage and a gate-off voltage are changed according to the method of operating the display device of FIG. 11.

FIG. 11 is a flowchart illustrating a method of operating a display device according to another embodiment of the inventive concept. FIG. 12 is a timing diagram illustrating an example in which a blank voltage and a gate-off voltage are changed according to the method of operating the display device of FIG. 11.

Referring to FIGS. 1, 11, and 12, the data driver 200 may provide the data voltages as the data signals DS to the plurality of pixels PX during the active period of the frame period (S310). The gate driver 300 may provide the gate-on voltage as the gate signals GS to the plurality of pixels PX during the active period of the frame period (S330).

The data driver 200 may provide the blank voltage as the data signals DS to the plurality of pixels PX during the blank period following the active period (S350). The gate driver 300 may provide the gate-off voltage as the gate signals GS to the plurality of pixels PX during the blank period (S370).

The controller 400 may compare the time of the blank period with the predetermined time (S390). In an embodiment, the active period may be the fixed active period having the constant time length, and the blank period may be the variable blank period having the variable time length. In addition, the predetermined time may be the time of the blank period corresponding to the maximum frame rate in the variable frame rate range supported by the display device 1000.

When the time of the blank period reaches the predetermined time, if the blank period ends and the next frame period starts (S390: NO), the controller 400 may control the data driver 200 such that the data driver 200 provides the data voltages to the plurality of pixels PX during the active period of the next frame period (S310) and may control the gate driver 300 such that the gate driver provides the gate-on voltage to the plurality of pixels PX during the active period of the next frame period (S330).

On the other hand, when the time of the blank period reaches the predetermined time, if the blank period continues without being finished (S390: YES), the controller 400 may control the data driver 200 such that the data driver 200 provides the increased blank voltage to the plurality of pixels PX during the blank period after the predetermined time (S410). In addition, the controller 400 may control the gate driver 300 such that the gate driver 300 provides a gradually increasing gate-off voltage to the plurality of pixels PX during the blank period after the predetermined time (S430).

In other words, when the time of the blank period reaches the predetermined time, if the blank period continues without being finished (S390: YES), the data driver 200 may provide the increased blank voltage to the plurality of pixels PX during the blank period BLANK2_2 after the predetermined time.

In addition, when the time of the blank period reaches the predetermined time, if the blank period continues without being finished (S390: YES), the gate driver 300 may provide the gate-off voltage VSS, which is gradually increased, to the plurality of pixels PX during the blank period BLANK2_2 after the predetermined time. For example, during the blank period BLANK2_1 before the predetermined time passes, the gate-off voltage VSS of about −9V may be provided to the plurality of pixels PX, and during the blank period BLANK2_2 after the predetermined time, the gate-off voltage VSS gradually increased to about −7V may be provided to the plurality of pixels PX.

Since the gate-off voltage VSS gradually increases, during a period in which the gate-off voltage VSS is relatively low in the blank period BLANK2_2 after the predetermined time, an amount of current flowing through the switching transistor TR may be relatively small. Accordingly, the data voltage charged in the liquid crystal capacitor CLC and the storage capacitor CST may not leak through the switching transistor TR. In addition, during a period in which the gate-off voltage VSS is relatively high in the blank period BLANK2_2 after the predetermined time, the increased blank voltage may be provided to the liquid crystal capacitor CLC and the storage capacitor CST through the switching transistor TR. Accordingly, the data voltage charged in the liquid crystal capacitor CLC and the storage capacitor CST may not leak through the switching transistor TR.

FIGS. 13 to 16 are timing diagrams illustrating examples in which a blank voltage and a gate-off voltage are changed according to still another embodiment of inventive concept.

Referring to FIGS. 13 to 16, since it is substantially the same as described above except for a blank period BLANK3 of a third frame period F3, the blank period BLANK3 of the third frame period F3 will be described below.

In the above-described variable frame mode, time lengths of the blank periods BLANK1, BLANK2, and BLANK3 may vary according to time lengths of each of the frame periods F1, F2, and F3. For example, the time length of the blank period BLANK2 of the second frame period F2 may be increased than the time length of the blank period BLANK1 of the first frame period F1, and the time length of the blank period BLANK3 of the third frame period F3 may be increased than the time length of the blank period BLANK2 of the second frame period F2.

For example, the host processor may output the third frame data FD3 during the active period ACT3 of the third frame period F3, and may continue the blank period BLANK3 of the third frame period F3 until the rendering 470 of the fourth frame data FD4 is completed. Therefore, when the fourth frame data FD4 is rendered 470 at a frequency of about 48 Hz in the third frame period F3, the host processor may provide the third frame data FD3 to the display device 1000 at a frame rate of about 48 Hz by increasing the blank period BLANK3 of the third frame period F3.

Accordingly, the blank period BLANK3 of the third frame period F3 may be divided into a blank period BLANK3_1 before the predetermined time passes and blank periods BLANK3_2 and BLANK3_3 after the predetermined time. The blank periods BLANK3_2 and BLANK3_3 after the predetermined time of the third frame period F3 may include the blank period BLANK3_2 having the same time length as the blank period BLANK2_2 after the predetermined time among the blank period BLANK2 of the second frame period F2 and the blank period BLANK3_3 after the blank period BLANK3_2.

Figure 13:
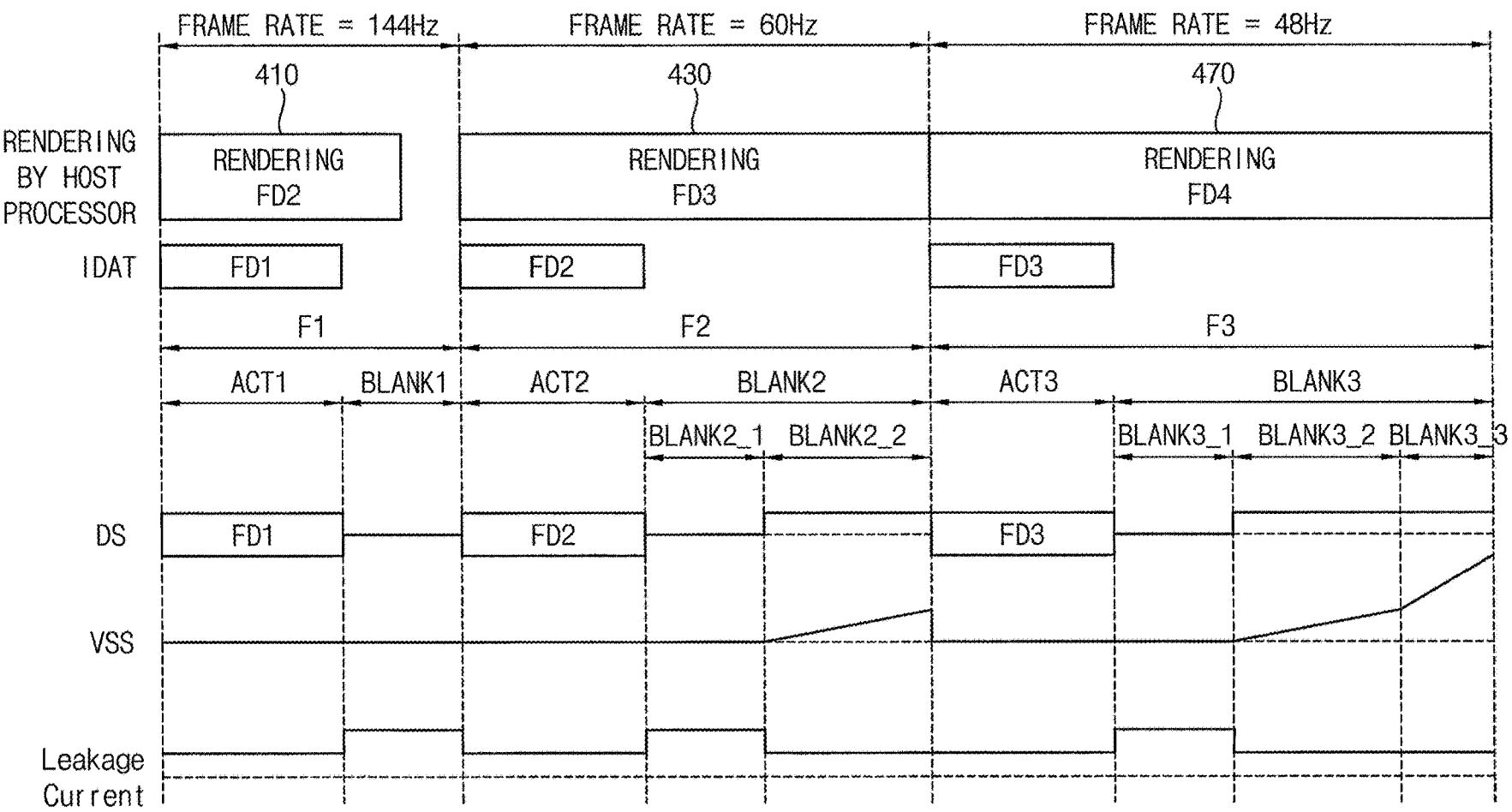
FIGS. 13 to 16 are timing diagrams illustrating examples in which a blank voltage and a gate-off voltage are changed according to still another embodiment of inventive concept.

In an embodiment, as shown in FIG. 13, the controller 400 may control the gate driver 300 to gradually increase the gate-off voltage VSS according to the time length of the blank period BLANK3 of the third frame period F3. For example, the plurality of pixels PX may be provided with a constant gate-off voltage VSS during the blank period BLANK3_1 before the predetermined time is reached, may be provided with the gate-off voltage VSS that gradually increases with a constant slope during the subsequent blank period BLANK3_2, and may be provided with a gate-off voltage VSS that gradually increases with a slope greater than the constant slope of the subsequent blank period BLANK3_2 during the subsequent blank period BLANK3_3.

In another embodiment, the plurality of pixels PX may be provided with the constant gate-off voltage VSS during the blank period BLANK3_1 before the predetermined time is reached, may be provided with the gate-off voltage VSS that gradually increases with the constant slope during the subsequent blank period BLANK3_2, and may be provided with a gate-off voltage VSS that gradually increases with a slope smaller than the constant slope of the subsequent blank period BLANK3_2 during the subsequent blank period BLANK3_3 (not shown).

Figure 14:
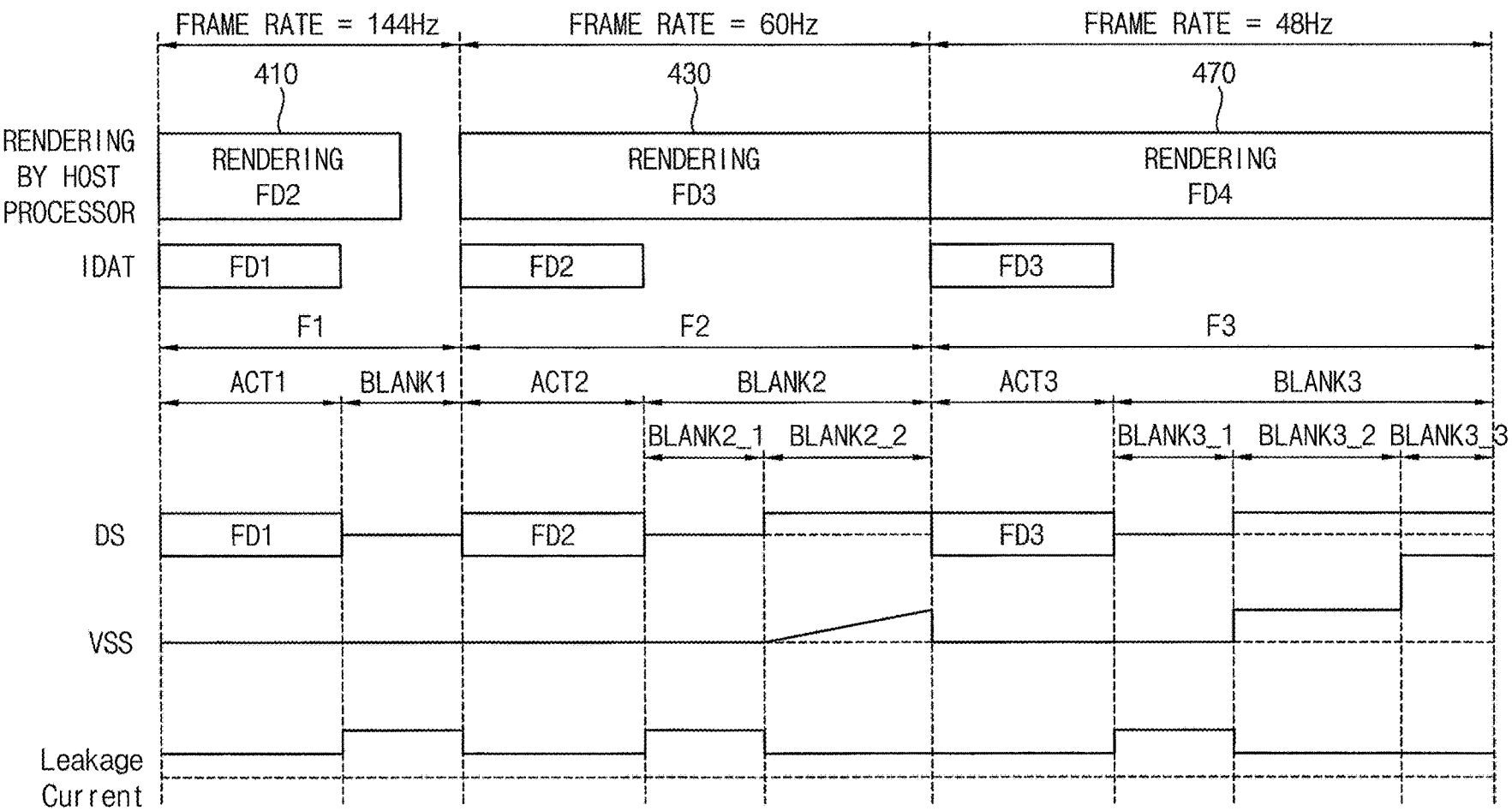

In still another embodiment, as shown in FIG. 14, the controller 400 may control the gate driver 300 to increase the gate-off voltage VSS in a stepped shape depending on the time length of the blank period BLANK3 of the third frame period F3. For example, the plurality of pixels PX may be provided with a constant gate-off voltage VSS during the blank period BLANK3_1 before the predetermined time passes, may be provided with the increased constant gate-off voltage VSS during the subsequent blank period BLANK3_2, and may be provided with a further increased constant gate-off voltage VSS during the subsequent blank period BLANK3_3.

Figure 15:
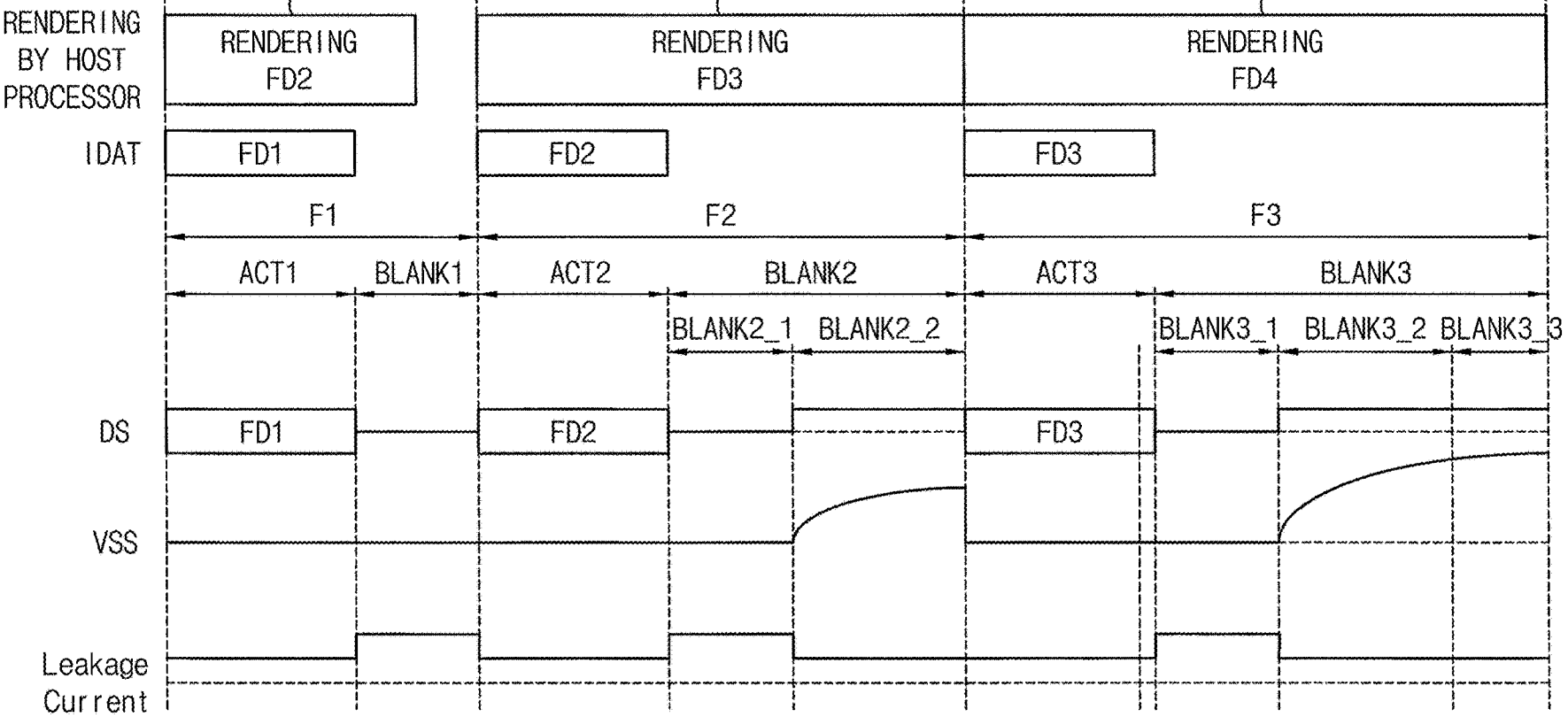

In still another embodiment, as shown in FIG. 15, the controller 400 may control the gate driver 300 to increase the gate-off voltage VSS in an upwardly convex shape depending on the time length of the blank period BLANK3 of the third frame period F3. For example, the plurality of pixels PX may be provided with a constant gate-off voltage VSS during the blank period BLANK3_1 before the predetermined time passes, and may be provided with a gate-off voltage VSS of which slope gradually decreases during the subsequent blank periods BLANK3_2 and BLANK3_3, such that the plurality of pixels PX may be provided with a gate-off voltage VSS that rapidly increases during the subsequent blank period BLANK3_2 and then gradually increases during the subsequent blank period BLANK3_3.

Figure 16:
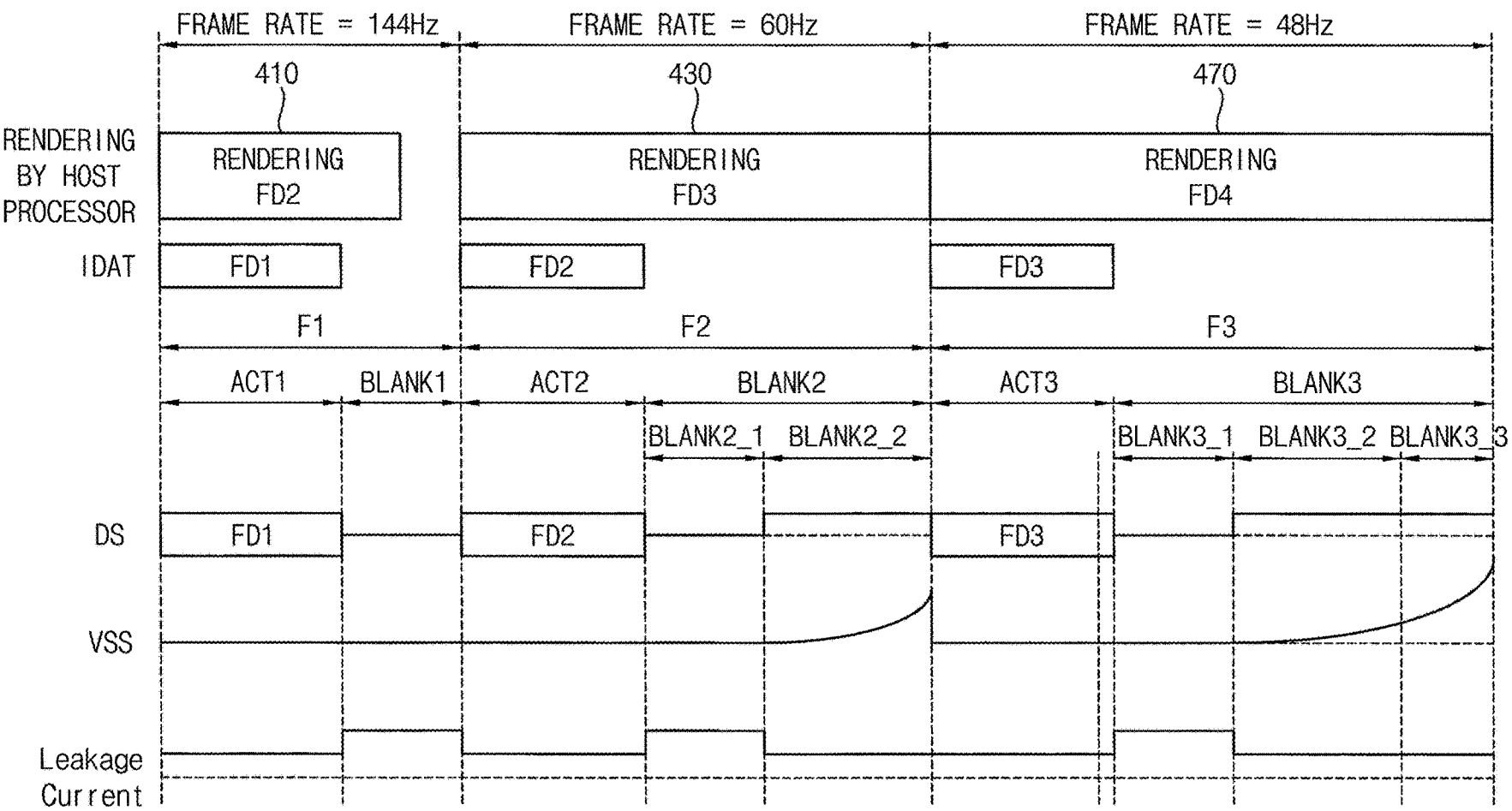

In still another embodiment, as shown in FIG. 16, the controller 400 may control the gate driver 300 to increase the gate-off voltage VSS in a downwardly convex shape depending on the time length of the blank period BLANK3 of the third frame period F3. For example, the plurality of pixels PX may be provided with a constant gate-off voltage VSS during the blank period BLANK3_1 before the predetermined time is reached, and may be provided with a gate-off voltage VSS of which slope gradually increases during the subsequent blank periods BLANK3_2 and BLANK3_3, such that the plurality of pixels PX may be provided with a gate-off voltage VSS that gradually increases during the subsequent blank period BLANK3_2 and then rapidly increases during the subsequent blank period BLANK3_3.

Methods of controlling the gate driver 300 by the controller 400 to set the gate-off voltage VSS provided to the plurality of pixels PX during the blank period according to the inventive concept are not limited to the above. In another embodiment, for example, the controller 400 may control the data driver 200 to set the blank voltage provided to the plurality of pixels PX during the blank period. For another example, the controller 400 may control the data driver 200 to gradually increase the blank voltage, to increase the blank voltage in a step shape, to increase the blank voltage in an upwardly convex shape, or to increase the blank voltage in a downwardly convex shape.

Embodiments of the present inventive concept may be applied to display devices and electronic devices including the display devices. For example, the present inventive concept may be applied to a cellular phone, a smart phone, a video phone, a smart pad, a smart watch, a tablet PC, a car navigation system, a television, a computer monitor, a laptop or notebook computer, a head mounted display device, an MP3 player, etc.

While the inventive concept has been particularly shown and described with reference to the exemplary embodiments thereof, it will be understood by one of ordinary skill in the art that variations in form and detail may be made therein without departing from the spirit and scope of the inventive concept as defined by the following claims.

What is claimed is:

1. A display device, comprising:

a display panel including a plurality of pixels;

a data driver which provides data voltages to the plurality of pixels through data lines during an active period of a frame period and provides a blank voltage to the plurality of pixels through the data lines during a blank period of the frame period;

a gate driver which provides a gate-on voltage to the plurality of pixels through gate lines during the active period and provides a gate-off voltage to the plurality of pixels through the gate lines during the blank period; and a controller which controls the data driver and the gate driver, wherein the blank voltage increases and the gate-off voltage increases, when a time in the blank period reaches a predetermined time.

2. The display device of claim 1, wherein the active period has a constant time length and the blank period has a variable time length.

3. The display device of claim 1, wherein the predetermined time is a length of the blank period corresponding to a maximum frame rate in a variable frame rate range supported by the display device.

4. The display device of claim 1, wherein the gate-off voltage before the predetermined time is reached has a first negative value and the gate-off voltage after the predetermined time has a second negative value, and wherein an absolute value of the second negative value is smaller than an absolute value of the first negative value.

5. The display device of claim 1, wherein the gate-off voltage after the predetermined time is constant.

6. The display device of claim 1, wherein the gate-off voltage after the predetermined time increases gradually as the time in the blank period increases.

7. The display device of claim 1, wherein the blank voltage after the predetermined time is set to an average value of the data voltages provided to the plurality of pixels during the active period.

8. The display device of claim 1, wherein the blank voltage after the predetermined time is set to a maximum value of the data voltages provided to the plurality of pixels during the active period.

9. The display device of claim 1, wherein the blank voltage after the predetermined time is set to a same value as the data voltage corresponding to a maximum gray level.

10. The display device of claim 1, wherein the blank voltage after the predetermined time is set for each of the data lines.

11. The display device of claim 1, wherein a leakage current of the plurality of pixels reduces based on the blank voltage during the blank period after the predetermined time.

12. A method of operating a display device, comprising:

providing data voltages to a plurality of pixels during an active period of a frame period;

providing a gate-on voltage to the plurality of pixels during the active period;

providing a blank voltage to the plurality of pixels during a blank period of the frame period;

providing a gate-off voltage to the plurality of pixels during the blank period;

increasing the blank voltage when a time in the blank period reaches a predetermined time; and increasing the gate-off voltage when the time in the blank period reaches a predetermined time.

13. The method of claim 12, wherein the active period has a constant time length and the blank period has a variable time length.

14. The method of claim 12, wherein the predetermined time is a length of the blank period corresponding to a maximum frame rate in a variable frame rate range supported by the display device.

15. The method of claim 12, wherein the gate-off voltage after the predetermined time is constant.

16. The method of claim 12, wherein the gate-off voltage after the predetermined time increases gradually as the time in the blank period increases.

17. The method of claim 12, wherein the blank voltage after the predetermined time is set to an average value of the data voltages provided to the plurality of pixels during the active period.

18. The method of claim 12, wherein the blank voltage after the predetermined time is set to a maximum value of the data voltages provided to the plurality of pixels during the active period.

19. The method of claim 12, wherein the blank voltage after the predetermined time is set to a same value as the data voltage corresponding to a maximum gray level.

20. The method of claim 12, wherein the blank voltage after the predetermined time is set for each of the data lines.

* * * * *